United States Patent [19]

Tosswill

[11] Patent Number: 4,931,688

[45] Date of Patent: Jun. 5, 1990

[54] MULTIFUNCTION GAS TRIODE

[75] Inventor: Christopher H. Tosswill, Glen Cove, Me.

[73] Assignee: Galileo Electro-Optics Corp., Sturbridge, Mass.

[21] Appl. No.: 145,418

[22] Filed: Jan. 19, 1988

[51] Int. Cl.[5] ..... H01J 1/16

[52] U.S. Cl. ..... 313/336

[58] Field of Search ..... 313/336, 306, 325; 340/577, 578

[56] References Cited

U.S. PATENT DOCUMENTS 3,087,092 4/1963 Lafferty ..... 313/306 X 4,604,554 8/1986 Woodton ..... 313/325 X

OTHER PUBLICATIONS

Tosswill, C. H., "Cold Cathode Trigger Tubes", 18 Philips Technical Review 128 (1956/57).

*Primary Examiner*—Sandra O'Shea

[57] ABSTRACT

A gas-filled triode with an anode, a cathode, and a control electrode therebetween having trigger and corona portions defining gaps respectively with the anode and cathode. The triode detects energy falling upon the cathode and produces an amplified output corresponding thereto through the anode gap.

6 Claims, 1 Drawing Sheet

MULTIFUNCTION GAS TRIODE

FIELD OF THE INVENTION

This invention relates to gas triodes, and more particularly to such triodes useful to, in a single triode, both detect and amplify.

BACKGROUND OF THE INVENTION

Cold-cathode trigger triodes and tetrodes for detection or amplification have long been known, as discussed in "Cold Cathode Trigger Tubes", C. H. Toswill, 18 Philips Technical Review 128 (1956/57).

A practical prior art Sylvania flame detector employs a wire photocathode.

SUMMARY OF THE INVENTION

I have discovered that useful detection and amplification can be provided in a single tube, in a triode having an anode, a cathode, and a control electrode intermediate of them and at respectively trigger and corona portions interacting with both anode and cathode.

In preferred embodiments, an applied voltage acts both to charge a capacitor and to power the anode, the capacitor also powering the anode; the control electrode is connected to ground through a resistor; and the cathode, upon impact of ultraviolet rays characteristic of flames, releases electrons, to provide a flame detector.

DESCRIPTION OF THE PREFERRED EMBODIMENT

A description of the presently preferred embodiment follows.

Drawings

Figure 1:
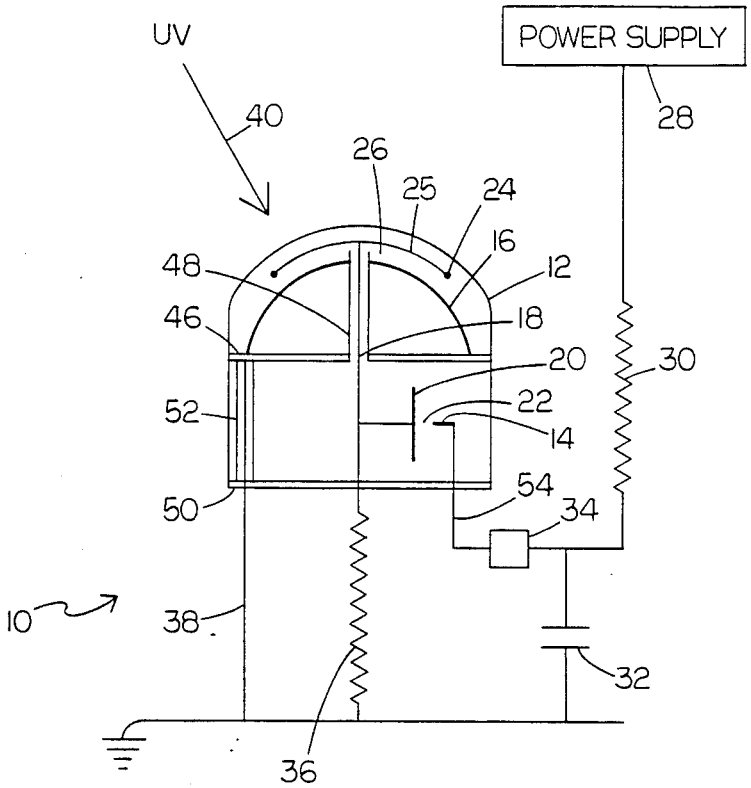

FIG. 1 is a diagrammatic view of said embodiment, with related circuitry.

Figure 2:
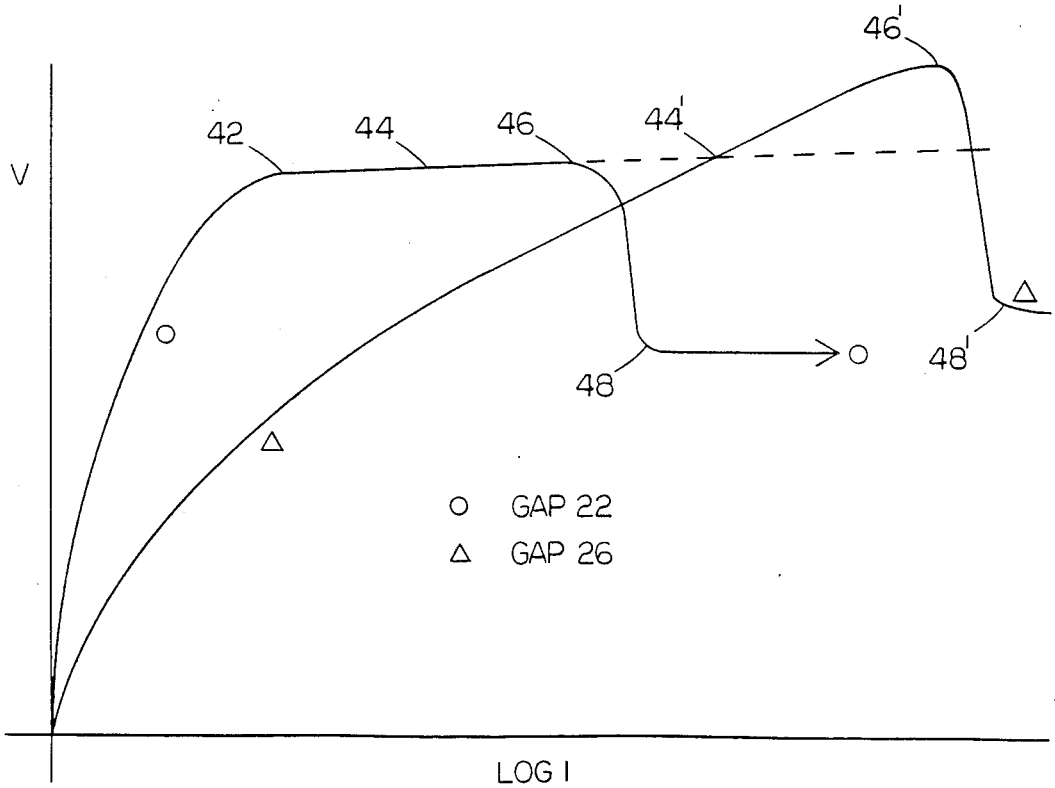

FIG. 2 sets forth graphs showing voltage: current relationships in the gaps between (1) the anode and the trigger portion of the control electrode and (2) the cathode and the corona portion of the control electrode.

Structure

In FIG. 1 is indicated generally at 10 said preferred embodiment.

Glass envelope 12 transparent to near-ultraviolet radiation, 15 mm 0.D., and filled at a pressure of 25 mm Hg with a 97% neon 3% argon mixture has disposed within it anode 14, cathode 16 surfaced with material that on impact thereon of near-ultraviolet energy releases electrons, and control electrode 18. Trigger portion 20 of control electrode 18 defines with anode 14 gap 22. Corona portion 24 (a ring of 100 micron tungsten wire supported by two crossing wires 25, each support 25 in turn being centrally supported by a bead—not shown—atop vertical 0.5 mm nickel wire portion of control electrode 18) defines with cathode 16 gap 26. D.C. power supply 28 for applying a potential of 300 volts is connected through 10 kilohm resistor 30 to one microfarad capacitor 32 and (through current metering means 34) anode 14.

Control electrode 18 is connected through 1 teraohm resistor 36 to ground.

Cathode 16 is connected through line 38 to ground.

Wires 38, 18, and 54 extend through, along a diameter thereof, glass wall 50, in which they are sealed.

Ceramic insulator disk 46 prevents shorting between anode and cathode and carries ceramic tube 48 through which extends (with say 0.1 mm annular clearance) wire portion 18.

Between glass lower portion 50 of envelope 12 and disk 46 extends ceramic tube 52 through which wire 38 similarly extends.

OPERATION

To begin operation, the 300-volt potential is applied through resistor 30 to capacitor 32 and anode 14. The former begins to charge, and the latter to create a current flow across anode gap 22; when such flow is implemented, voltage on the anode has dropped to 150, so that voltage on control electrode 18 is also 150, and thus to ground across both cathode gap 26 and resistor 36, is 150. The tube is now primed.

If rays of near-ultraviolet light 40 now enter envelope 10 and fall on cathode 16, electrons are released at cathode 16.. Owing to the voltage across cathode gap 26, these electrons are drawn toward corona portion 24, and by the time they reach it have been multiplied at least a thousandfold, to produce a relatively large current. These electrons must flow in a current somewhere, and because resistance 36 is too great to accommodate their passage, flow through gap 22 and anode 14. (Ohm's law is of course inapplicable to flow of this character.)

As noted, FIG. 2 plots voltage drop against, in effect, current, in the gaps 22 and 26. Current rises from nothing before any flow in the gap 22 is established until at 42 a plateau 44 is reached, when priming is complete; so long as no uv impinges, the primed device remains on this plateau. Resistor 36 limits current flow in gap 22 to a figure on the plateau.

Once current flow exceeds the plateau maximum flow point 46, voltage across gap 22 drops, owing to space charge distortion of the electric field in the lower portion of the tube 10. The voltage across anode gap 22 thus drops to about 100. Glow discharge begins in this zone when current and voltage are at point 48. (As is well known, glow discharge requires both a relatively higher current (than in the initial portion of the curve) and a relatively lower voltage (than on the plateau of the curve).

But voltage drop across gap 22 means an increase in voltage at control electrode 18, since anode voltage is maintained for a time by capacitor 32. This increase causes an expansion of discharge in the upper portion of tube 10 from a thin sheath around corona portion 24 to a glow discharge occupying the upper part of the tube.

Now, with glow, discharge in both portions of the tube, current in excess of 10 milliamps flows from anode to control electrode to cathode. Capacitor 32 sustains this flow until, in a mechanism described at page 134 of my publication above cited, voltage at the anode drops below that sufficient to maintain current flow across gaps 26 and 22; current flow then ceases throughout the tube.

Another cycle then automatically begins: capacitor 32 is recharged, there is repriming through gap 22, and if appropriate uv is coming in, the rest of the cycle is run through once again.

A sawtooth signal output is noted at meter 34, one tooth for each cycle.

The gap 26 curve in FIG. 2 sets forth relationships there coincident with those shown for gap 22. Primed correspondingly numbered points on the gap 26 curve correspond functionally (although not temporally) to correspondingly numbered unprimed points on the other curve.

This device has the advantage of great sensitivity (with its larger-than-wire photocathode and amplification), long life (owing to use of inert gases only), ability to deliver a direct current output whether powered by direct or alternating current, and, ability to function with either European or United States standard consumer outlet voltages.

OTHER EMBODIMENTS

Other embodiments will occur to those skilled in the art.

The cathode might emit responsively to other types of energy than uv. Inert gas and its pressure could vary, as could, for example, electrode materials. Electrodes could be made of other materials than nickel, as used in the three electrodes of the preferred embodiment. The power supply may be a.c. (because of the differing areas of cathode and corona portion, d.c. operation in effect nevertheless results). The insulator disk could be of mica.

What is claimed is:

1. A gas triode comprising
an anode,
a cathode, and
a control electrode, said control electrode having a trigger portion and a corona portion,
said trigger portion being spaced from said anode to provide an anode gap, and
said corona portion being spaced from said cathode to provide a cathode gap, said corona portion being connected to said trigger portion.

2. The triode of claim 1 in which said anode is provided with potential by both a power supply and a capacitor.

3. The triode of claim 1 in which said control electrode is also connected through a large resistor to ground.

4. The triode of claim 1 in which said cathode releases electrons when impinged on by uv radiation.

5. The triode of claim 2 in which said cathode releases electrons when impinged on by uv radiation, and said control electrode is connected through a large resistor to ground.

6. The triode of claim 1 in which cathode areas exceeds corona electrode portion area, to facilitate both energy input to said cathode and a.c. power supply use.

* * * * *